United States Patent [19]

Hofstein

[11] 3,949,264

[45] Apr. 6, 1976

[54] ELECTRONIC STORAGE TUBE TARGET STRUCTURE AND METHOD OF OPERATION

[75] Inventor: Steven R. Hofstein, Princeton, N.J.

[73] Assignee: Princeton Electronics Products, Inc., North Brunswick, N.J.

[22] Filed: Mar. 8, 1974

[21] Appl. No.: 448,614

[52] U.S. Cl. ..... 315/12 R; 313/391; 313/394; 315/11

[51] Int. Cl.[2] ..... H01J 29/41

[58] Field of Search ..... 315/10, 11, 12; 313/391, 313/394

[56] References Cited

UNITED STATES PATENTS

| | | | |
|---|---|---|---|
| 3,585,439 | 6/1971 | Schneeberger | 315/11 |
| 3,818,262 | 6/1974 | Forgue | 315/11 |
| 3,841,928 | 10/1974 | Takemoto et al. | 315/11 |

*Primary Examiner*—Maynard R. Wilbur
*Assistant Examiner*—G. E. Montone
*Attorney, Agent, or Firm*—Ostrolenk, Faber, Gerb & Soffen

[57] ABSTRACT

An electronic storage tube of the electron beam modulated type employing a target structure of the "coplanar grid" type in which the coplanar grid is a multilayered structure having at least one layer thereof which is more immune to ionizing radiation, such as X-rays, than at least one of the remaining layers, to yield a target structure in which erasure time and retention time are both significantly improved even though the stored pattern is repetitively read out.

A method is also described herein for operating target structures of the type described hereinabove to take advantage of the above mentioned advantageous characteristics and thereby yield an electronic storage tube having operating characteristics not heretofore capable of being provided in conventional structures.

40 Claims, 20 Drawing Figures

FIG. 2a.
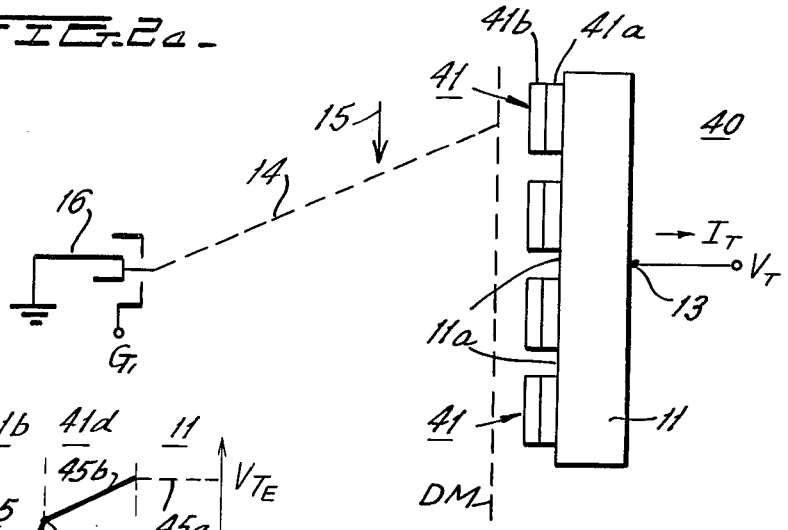
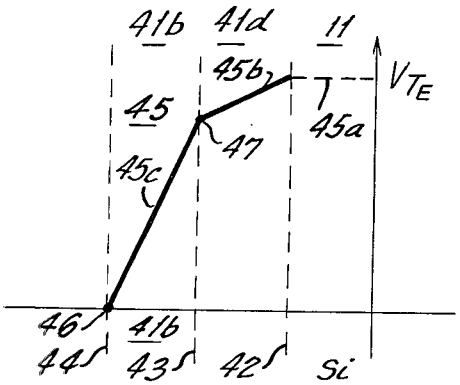
FIG. 2b.
FIG. 2c.
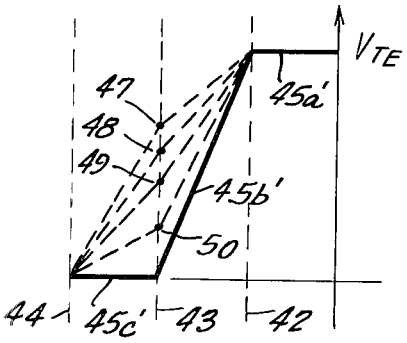
FIG. 2e.
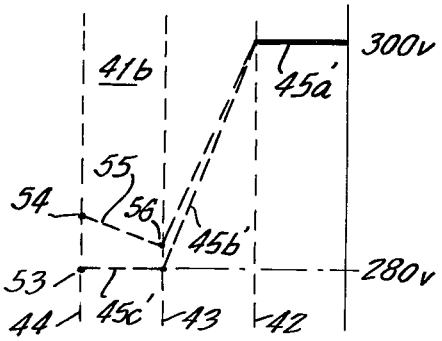
FIG. 2d.
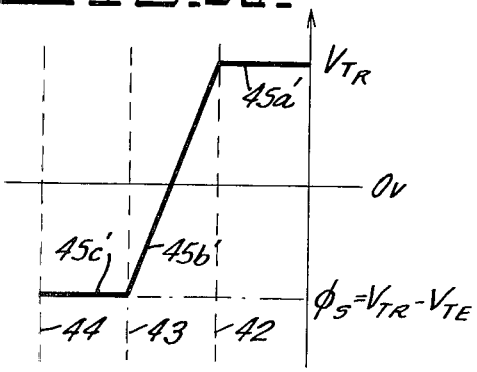
FIG. 2f.
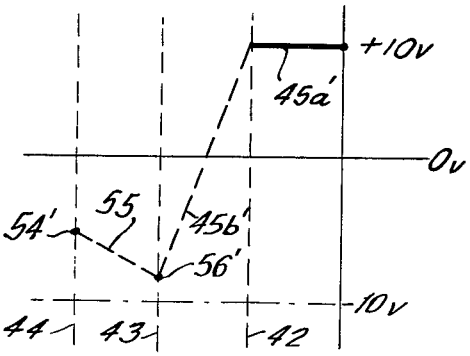

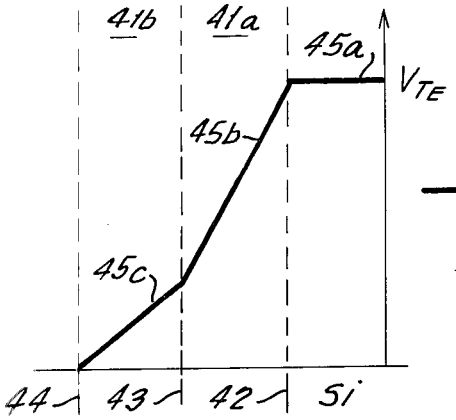
FIG. 4a.
FIG. 4b.
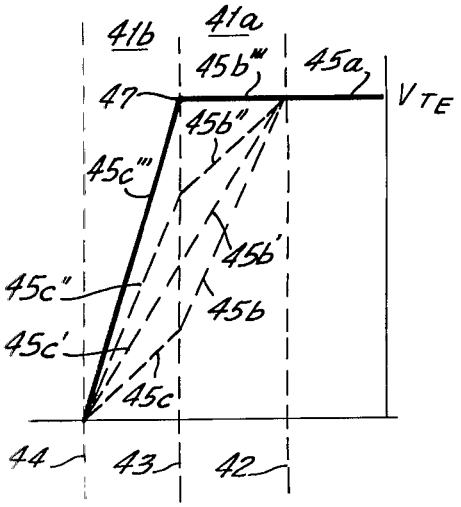
FIG. 4d.
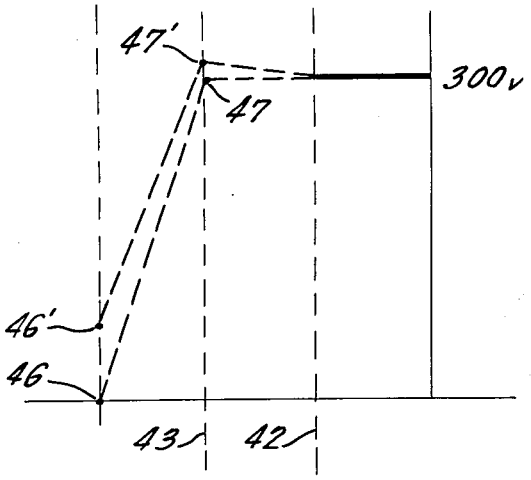
FIG. 4c.
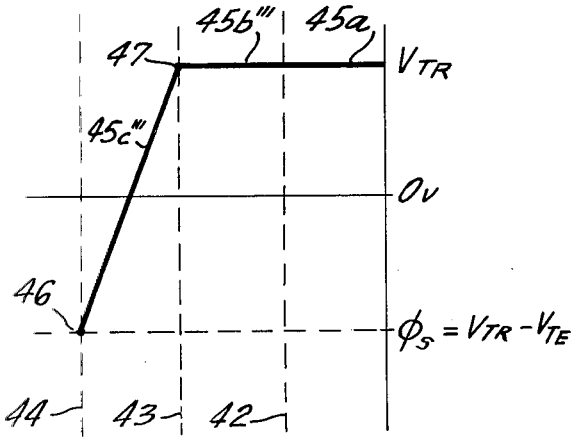
FIG. 4e.
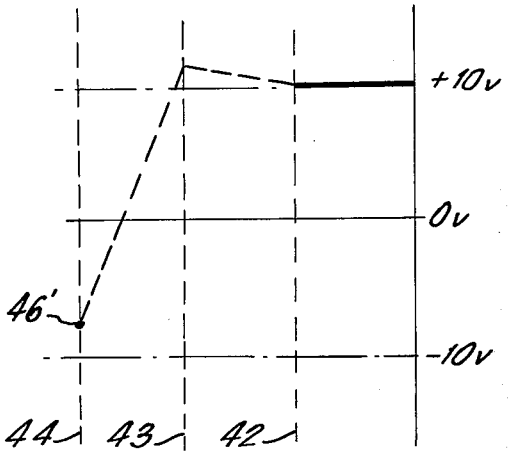

ELECTRONIC STORAGE TUBE TARGET STRUCTURE AND METHOD OF OPERATION

The present invention relates to electronic storage tubes and more particularly to electronic storage tubes having targets of the "coplanar grid" type utilizing beam-current control reading (see "Electronic Image Storage" by Kazan & Miknoll, Academic Press 1968, page 123) in which the coplanar grid is a multilayered structure, one of the layers serving as a miniature "battery" which functions to yield significant improvements in erasure time and retention time. Method and apparatus is also described herein for operating such tubes to obtain the above mentioned desired results.

BACKGROUND OF THE INVENTION

Electronic storage tubes employing targets of the "coplanar grid" type are already in use and have a capability of storing an image and retaining the stored image even after repeated write operations. Electronic storage tubes of the type to be described herein in greater detail have three basic operating modes, namely a read mode, a write mode and an erasure mode. The write mode is typically performed after completion of an erase mode which consists of developing a substantially uniform charge pattern upon the coplanar grid of the target which charge pattern prevents the electron beam from striking the target conductive member so as to yield a uniform "black" picture.

In the write mode, the substantially uniform charge pattern is modified by increasing the target voltage level to a value sufficient to enhance the secondary emission of the coplanar grid when struck by a modulated electron beam such that a greater member of electrons are "knocked off" of the coplanar grid than are retained thereby due to the striking of the coplanar grid by the electron beam at high velocity. The "knocked off" electrons are collected by the deceleration grid mesh of the tube. This results in a modified surface charge pattern which is more positive at those locations where a beam of greater electron density has struck the coplanar grid.

During the read mode, the target voltage is significantly reduced and an unmodulated electron beam (i.e. of constant beam current) is caused to scan the target. The surface charge pattern upon the coplanar grid serves in a manner analogous to the control grid of a vacuum tube triode selectively controlling the amount of electrons from the electron beam permitted to strike the target conducting surface as a function of the charge pattern. Since the charge pattern, although non-uniform, is more negative than the potential at the cathode of the electron gun structure, no electrons strike the coplanar grid structure enabling the image formed during the write mode to be retained and thereby permitting repeated read operations without image loss.

It has been found that electrons impacting the deceleration grid mesh during read operations generate ionizing radiation (i.e. X-radiation) which greatly increases the conductivity of the coplanar grid material causing an undesirable decrease in the retention time.

BRIEF DESCRIPTION OF THE INVENTION AND OBJECTS

The present invention has as a primary objective the provision of a multilayered coplanar grid structure for electron storage tube targets which significantly enhances the capability of the target structure to retain the image stored therein even in the presence of radiation.

In one preferred embodiment of the present invention the target structure is comprised of a conductive silicon target having a coplanar grid structure comprised of a plurality of layers arranged in a predetermined pattern. At least one layer of the coplanar grid structure is deposited directly upon one surface of the conducting silicon and is formed of a material which is substantially insensitive to X-radiation. A second layer is deposited upon the first layer so as to form substantially the same pattern as said first layer and is comprised of a material whose dielectric constant is significantly less than the dielectric constant of the aforesaid first layer to produce a target structure whose quality factor K, which is directly proportional to target retention time and inversely proportional to target erasure time, is greatly enhanced.

A method and apparatus is also described herein for operating target structures of the above mentioned type in which the target is "conditioned" to create a charge across the radiation insensitive layer which functions as a miniature "battery" serving to prevent the leakage of charge from the second layer to the conducting target member of the target and further providing the unique feature of preventing the second layer from losing its charge pattern and drifting toward the "white" condition as is the case in conventional structures such that, due to the presence of the aforesaid first layer, the second layer will advantageously drift toward the "black" condition as it loses its charge pattern. The novel electronic storage tube target structure is "conditioned" by raising the target potential to a positive value with reference to the cathode and scanning the target with an electron beam to discharge the charge pattern on the surface of the second layer to cathode potential and to cause the first and second layers to develop a charge pattern such that a potential difference is developed across the second layer. Thereafter, the target structure is exposed to ionizing radiation causing the charge pattern developed upon the second layer to "leak" or transfer to the interface between the first and second layers whereby the voltage gradient across the first layer increases and the voltage gradient across the second layer is substantially reduced to zero. Alternatively, the ionizing radiation may be generated simultaneously with the discharge or erase of the target. In this case, a steady state condition will be reached when the potential gradient across the first layer is equal to full target erase potential and the voltage gradient across the second layer has reduced to zero, thereby "conditioning" the target to provide a significant improvement in the quality factor K.

BRIEF DESCRIPTION OF THE FIGURES

The above, as well as other features, advantages and objects will become apparent from a consideration of the following detailed description and drawings in which:

FIG. 2*a* shows a target structure designed in accordance with the principles of the present invention.

FIGS. 2*b*–2*f* are curves showing the potential distribution across the target structure of FIG. 2*a* for various operating modes of the electronic storage tube.

FIGS. 4*a*–4*e* show the potential distribution across the target structure for an alternative embodiment of the invention.

DETAILED DESCRIPTION OF THE FIGURES

The novel coplanar grid type storage target structure of the present invention and its novel method of operation has been found to yield a dramatic improvement in image retention time as well as a means of uniquely programming the format of the image fade characteristics developed by the novel target structure. Specifically, it is virtually universally known that the erase level of the coplanar grid structure charge pattern fades up as the negative charge pattern on the insulating grid members discharge by gas ions and/or radiation induced conductivity. In addition to the general degradation in the image contrast, the conventional mode of the fade also yields other very undesirable side effects in some applications.

For example, in graphic applications where "white" images or lines are written on a black or erased background, it is particularly desirable that the black background be highly stable to assure a long "working time" between erase cycles. For example, a stable background is essential to maintaining a satisfactory selective erase and editing capability.

As will be described more fully hereinbelow, the full range of target signal currents is controlled by a voltage shift on the coplanar grid surface which is only a fraction of the total voltage difference between the coplanar grid surface and the conducting silicon. This is significant for the reason that the influence of X-radiation from the grid deceleration mesh influences the coplanar grid layer to significantly increase its conductivity so that the voltage on its surface will shift towards the silicon potential $V_{TR}$.

The conventional coplanar grid type target normally operates such that a shift in insulator surface potential of only two to three volts is sufficient to cause the image to fade from black to mid-gray (the definition of retention time). Since the erase target voltage $V_{TE}$ is typically of the order of −20 volts, the effective retention time $\tau_r$ is only a fraction (typically 10%) of the relaxation time. In other words, the high coplanar grid fields developed when the grid surface undergoes an erasure operation can cause a significant radiation induced current to flow from the coplanar grid which rapidly shifts the insulator surface potential through its effective control range.

Figure 1A:
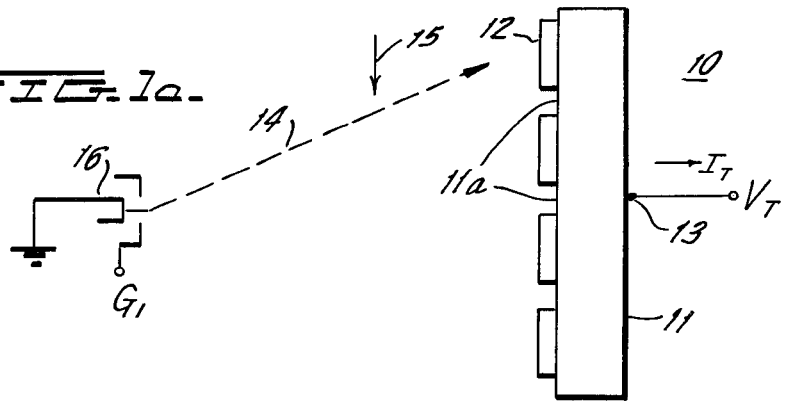
FIG. 1*a* shows a conventional "coplanar grid" type target.

The above concepts will be described in more detail in connection with FIGS. 1a through 1e as set forth herein below:

As shown in FIG. 1*a* the target structure 10 of a conventional "coplanar grid" type target is comprised of a conducting layer 11 which may typically be conducting silicon and which is provided with a plurality of areas of an insulating layer 12, typically silicon dioxide, which are preferably arranged in a stripped pattern. An electrode 13 is coupled to the conducting silicon for applying target voltage thereto. The signal is read out of the conducting silicon in the form of target current $I_T$ which target current is a function of the charge pattern developed by the coplanar grid as will be more fully described. The striped arrangement is such that the conducting silicon 11 has exposed surface portions 11*a* adapted to be scanned by electron beam 14 and being arranged between each adjacent pair of insulating areas which may preferably be in the form of strips 12.

Figure 1B:
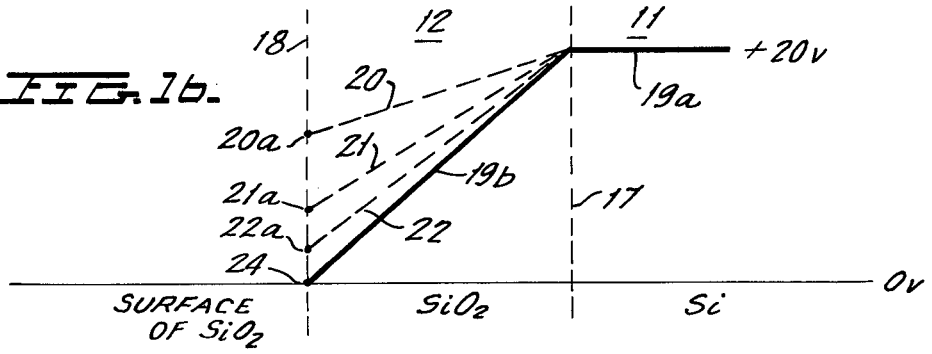
FIGS. 1*b*–1*e* show the voltage gradient patterns developed by the target structure of FIG. 1*a* in the various operating modes

The erase mode for the target structure 10 will now be described in conjunction with FIG. 1*b* which shows the electrical potential distribution across the target structure. A target voltage typically of the order of +20 volts (relative to the cathode) is applied to electrode 13. An electron beam 14 is generated and is swept in a direction shown by arrow 15 so as to move across the pattern of insulating strips 12. The electron beam is emitted from the electron gun cathode 16. Referring to FIG. 1*b* dotted line 17 represents the interface between the conducting silicon 11 and the coplanar grid 12 while dotted line 18 represents the surface of one of the strips 12. Curve portion 19*a* of curve 19 represents the potential of the target voltage (+20 volts) and the potential distribution across conductive layer 11. Let it be assumed that just prior to the sweep of the target by electron beam 14 that the surface of one strip was at a potential above 0 volts as represented by the point 20*a* in FIG. 1*b*. Thus dotted line 20 represents the potential gradient across the silicon dioxide layer 12. As the electron beam strikes the silicon dioxide, the electrons are collected on the surface to make it increasingly more negative so that surface voltage changes from a positive value designated by point 20*a* to increasingly more negative values designated by the points 21*a* and 22*a*, dotted lines 21 and 22 respectively representing the changing potential distribution across the insulating strip 12. The silicon dioxide strip will continue to accept electrons from the beam until its surface potential moves to a value of 0 volts as represented by point 24 in FIG. 1*b* whereupon no further electrons will be collected by the silicon dioxide strip since the cathode 16 of the electron gun is maintained at ground potential. At this time the potential gradient across the silicon dioxide strip is represented by curve portion 19*b* of FIG. 1*b*. Ultimately all points of each strip forming the coplanar grid which have been swept by the electron beam 14 will be at substantially the same potential (i.e. 0 volts).

Figure 1C:
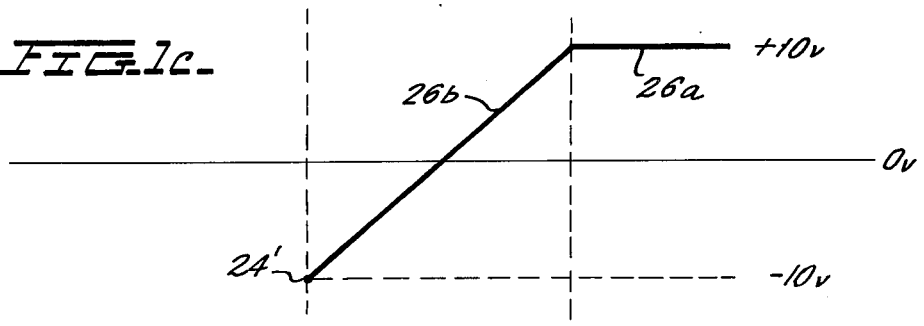

In order to test the satisfactory completion of the erasure operation, the target voltage is reduced to a value which is typically +10 volts as shown by curve portion 26*a* in FIG. 1*c*. At this time, the potential distribution across the silicon dioxide strip, which functions as a capacitor, remains constant so that point 24 of FIG. 1*b* moves abruptly to point 24' shown in FIG. 1*c* with curve portion 26*b* representing the potential distribution across the silicon dioxide strip 12. This will occur for all of the portions of every strip of the target structure scanned by the electron beam. With the target voltage being maintained at a level of +10 volts, an unmodulated electron beam (i.e. of constant beam current) is caused to scan the target and the target current $I_T$ (FIG. 1*a*) is detected, amplified and applied to a conventional cathode ray tube display (not shown for purposes of simplicity) which is swept in synchronism with the scanning of electron beam 14 in the electronic storage tube. Since the cathode 16 of the electron gun is maintained at ground potential (i.e. 0 volts) the surface voltage of −10 volts (see point 24' of FIG. 1*b*) typically prevents any electrons in the beam from striking the target areas 11a of the conducting silicon 11. This operation may be directly analogized to the operation of a vacuum tube triode whose control grid, when maintained at a level more negative than the cathode, will develop no grid current and when sufficiently negative, will cut off anode current. The target current $I_T$ applied to the cathode ray tube display device will be zero to develop a "black" picture indicating that the erasure operation has been successfully completed.

Figure 1D:
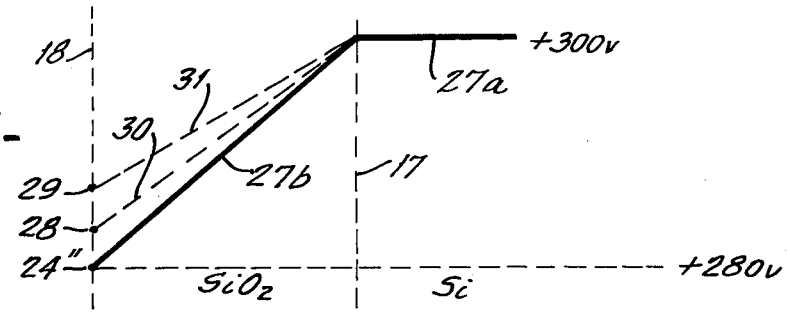

The write mode for the structure of FIG. 1*a* will now be described in connection with FIG. 1*d*.

The target voltage during the write mode is shifted upward to a level of the order of +300 volts. The potential distribution across the silicon dioxide strip 12 remains constant as represented by curve portion 27*b* with the surface potential represented by point 24'' being +280 volts.

The control grid G1 of the electron gun (see FIG. 1*a*) is modulated by a signal whose range is typically of the order of 10 volts peak to peak to control the intensity of the electron beam as it is swept across the target structure 10 (by suitable deflection means). The surface voltage (+280 volts) of the silicon dioxide is at a level high enough to cause the silicon dioxide to exhibit a high secondary emission ratio whereby many more electrons are "knocked off" of the surface of the strip 12 than are retained as a result of high velocity impingement of the electron beam upon the surface of the strips. The "knocked off" electrons are collected by the electron storage tube deceleration grid (not shown for purposes of simplicity). Thus the surface charge moves upwards from the value of +280 volts to an increasingly more positive value as shown by the points 28 and 29 of FIG. 1*d*, with the dotted lines 30 and 31 respectively representing the potential distribution across the silicon dioxide layer. It should be obvious that the charge pattern across the entire target can be made to be non-uniform and dependent upon the type of data or image being written therein. Therefore, the various locations along the surfaces of strips 12 will be at differing surface potentials so that the surface potential across the coplanar grid structure will typically be in the range from +280 volts to +290 volts with the specific values at such points collectively representing the image being stored.

The read mode will now be described in connection with FIG. 1*e*.

Figure 1E:
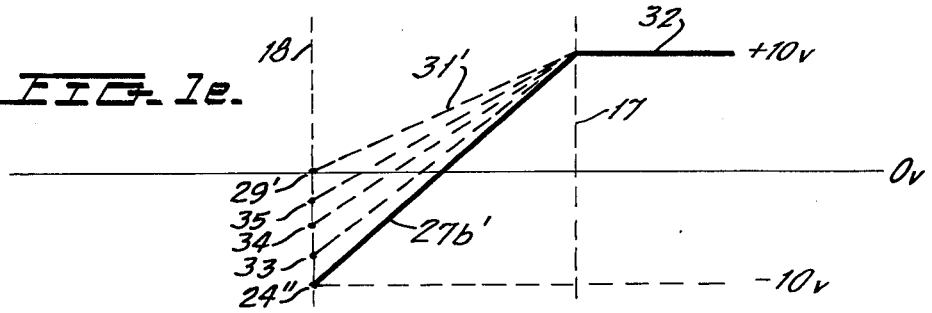

The target voltage $V_T$, during the read modes is shifted to a value of the order of +10 volts as represented by curve portion 32 in FIG. 1*e*. The surface potential of the silicon dioxide will range from a minumum value of −10 volts to a maximum value of 0 volts as represented by the points 24'' and 29'. The potential gradient between these two extremes are represented by the curves 27*b'* and 31' respectively. The unmodulated (i.e. constant density) electron beam 14 is caused to scan across the target and the target current is detected, amplified and applied to a typical cathode ray tube display device to modulate its scanning electron beam in accordance with the value of the target current as it is swept by electron beam 14 during the read mode. For those points along the coplanar grid surface which are at the level 24'' (i.e. −10 volts) no electrons from the beam will be permitted to strike the surface area of the conducting silicon immediately adjacent that portion of those portions of the coplanar grid structure whose surface potential is at the −10 volt level. For those points along the coplanar grid surface at the level 29' (i.e. 0 volts) there will be no repelling forces imposed upon the electron beam so that maximum target current will be generated at this time. For typical grid structures (i.e. grid area/total area = 30%) the operating range of surface potential for full current control is typically 3 to 4 volts. Hence, for these points along the grid structure surface having values between −6 and −10 volts, various levels of target current proportional to the surface potential will be created at these points. Since the most positive potential on the surface of the coplanar grid will be below the 0 volt level and preferably below the −5 volt level, electrons from the cathode 16 developing electron beam 14 (see FIG. 1*a*) will be repelled by the charged distribution pattern and hence the charge pattern stored by the grid surface will be unaffected by the electron beam during a read operation. The distinct advantage of this feature resides in the fact that many repeated operations may be performed (within limits) without any degradation in the image pattern.

As a practical matter, however, and through careful observation of the target as a result of extensive experimentation, it has been found that the striking of the electron beam upon the deceleration grid mesh causes ionizing radiation to develop which serves to significantly increase the conductivity of the silicon dioxide layer so that charge from its surface represented by dotted line 18 in FIG. 1*e* (which is more negative than the target voltage represented by curve portion 32) will drift toward the interface between the conducting silicon and the insulative grid to become progressively more and more positive as shown by the points 33, 34 and 35 whereupon the surface charge drifts upwardly toward the "white" condition which was defined hereinabove as that surface potential which permits maximum bombardment of the conducting silicon surface areas 11*a* by the electron beam 14 (see FIG. 1*a*).

The present invention is directed toward eliminating this undesirable feature which is accomplished through a target structure 40 as shown in FIG. 2*a* which in one preferred configuration comprises a conducting silicon member 11 having a plurality of elongated strips 41 arranged in a striped pattern much the same as that shown in FIG. 1a so that portions 11*a* of the conducting silicon 11 are exposed between each pair of adjacent strips. Each strip, in turn, is comprised of a layer of substantially radiation insensitive insulation material 41a having a second layer of insulation material 41*b* deposited thereon wherein each layer 41*b* preferably has a dielectric constant which is significantly less than the dielectric constant of the layers 41*a*. A radiation insensitive material is herein defined as one whose conductivity is substantially unchanged in the presence of ionizing radiation relative to its conductivity in the absence of ionizing radiation.

In one preferred embodiment of the present invention the layers 41*a* are formed of a material which is substantially immune to ionizing radiation such as X-rays. Suitable materials which may be employed for this purpose are aluminum oxide, silicon nitride and silicon oxy-nitride although any other insulation material exhibiting substantial immunity to ionizing radiation may be employed. The layers 41*b* are preferably formed of silicon dioxide.

The manner of operation of the target structure 40 will now be described in connection with FIG. 2*b* wherein dotted line 42 represents the interface between the conducting silicon and the silicon nitride, dotted line 43 represents the silicon nitride-silicon dioxide interface and dotted line 44 represents the surface of the silicon dioxide. Curve 45 represents the potential distribution across the target structure as represented by the curve portions 45*a*, 45*b* and 45*c* respectively. Let it be assumed that the target voltage $V_T$ is raised to a value which is substantially the same value as is employed during the erase mode and as represented in FIG. 2*b* by the symbol $V_{TE}$. Thus curve portion 45*a* represents the constant voltage level across the conducting silicon 11. The unmodulated electron beam 14 is caused to scan across the target structure 40 which accepts electrons from the beam reducing the surface potential ultimately to a value of 0 volts as represented by point 46 in FIG. 2*b* which is substantially identical to point 24 shown in FIG. 1b. Since the exposed surface of layers 41*b* will be at 0 volts at this time and since the electron gun cathode 16 is maintained at ground potential, the coplanar grid structure will accept no further electrons thus completing the erasure operation. The voltage distribution across the coplanar grid areas 41 is determined by the values of the dielectric constants of layers 41*b* and 41*a*. Since the relative capacitances of these layers are directly related to their dielectric constants, the voltage distribution across the layers will be developed in the manner shown be curve portions 45*b* and 45*c* with the layer 41*b* having the greater voltage gradient across its thickness due to its lower capacitance. Thus there is a "break" in the slope of the gradient at the silicon nitride/silicon dioxide interface 43, due to the fact that the dielectric constant of the silicon nitride is greater than that for the silicon dioxide.

If the target is allowed to stand in the presence of ionizing radiation and with the beam scanning for a time period which is significantly greater than the dielectric relaxation time $\tau_{rel}$, defined by $$\tau_{rel} = \epsilon_{ox}/\sigma_{ox}$$

where $\epsilon_{ox}$ = dielectric constant of the silicon dioxide and $\sigma_{ox}$ = conductivity of the silicon dioxide the charge developed across layer 41*b* will be altered in the manner shown in FIG. 2*c* so that the break point 47 (see FIGS. 2*b* and 2*c*) will continue to move downwardly along interface 43 to points 48, 49, 50 and so forth until all of the negative surface charge is transferred from surface 44 of layer 41*b* to the silicon dioxide-silicon nitride interface 43 such that the voltage gradient across layer 41*b* will be zero and substantially all of the voltage gradient will be across the layer 41*a* as represented by solid line curve portion 45*b*′ (solid line curve portion 45*c*′ representing the 0 gradient across layer 41*b*).

The operation of this novel coplanar type target structure will now be described for each of its various modes.

Turning to a consideration of FIG. 2*d* the target voltage is shifted to the read level $V_{TR}$. At this time the potential gradients across layers 41*a* and 41*b* remain as shown in FIG. 2*c* and abruptly shift downwardly as shown in FIG. 2*d* due to the downward shift in target voltage to the "read" level. Thus, even though the potential gradient across layer 41*b* is zero as represented by curve portion 45*c*′ of FIG. 2*d*, the surface potential $\Phi_s$, equals the target read voltage less the target erase potential (i.e. $\Phi_S = V_{TR} - V_{TE}$) and is well below the 0 volts level and in one typical embodiment of the order of −10 volts (when the target voltage is as +10 volts which is analogous to the arrangement shown in FIG. 1*c*).

The unmodulated electron beam 14 (see FIG. 2*a*) is then swept across the target in the same manner as was described hereinabove. Since the electron gun cathode 16 is maintained at reference potential, the uniform (−10 volt) level on the coplanar grid - i.e. on the surface 44 - prevents the electron beam from striking the exposed areas 11a of the conducting silicon 11 so that the detected target current ($I_T$) is zero providing a positive indication that the erasure operation has been successfully completed.

The important feature of the improved structure shown in FIG. 2*a* is that the silicon nitride layer, after having developed a potential distribution as shown in FIGS. 2*c* and 2*d*, act like an "electret" or miniature "bias battery" in generating a negative erase potential on surface 44 while at the same time maintaining the field across the layer 41*b* at a constant zero level. Hence, the erase condition is now stable even under the influence of ionizing radiation. An extremely novel condition which results from the structure of FIG. 2*a* and having a charge pattern as shown in FIG. 2*d* is that if the silicon dioxide surface potential is raised toward the 0 volt level (for example by gas ions or by having been written "white"), a reverse field will occur in layer 41*b* which reverse field will slowly return to zero due to the transport of negative charge from the silicon oxide-silicon nitride interface back to the silicon oxide surface which is now in the erase condition. Hence with this novel structure, the radiation actually maintains the erase level, and a "white" surface charge tends to fade "black" which is the reverse of conventional retention fade. This can be best understood from a consideration of FIG. 2*e*. Let it be assumed that the target voltage is raised to the "write" voltage level ($V_{TW}$) which is usually of the order of +300 volts. The potential distribution is then given by the curve portions 45*a*′, 45*b*′ and 45*c*′. The surfaces 44 of layers 41*b* (see FIG. 2*a*) will then be uniformly at a level of the order of +280 volts. The electron beam 14 is then caused to scan across the coplanar grid structure of the target and is modulated by the application of a signal whose peak to peak value may typically be of the order of 10 volts and which is applied to the control grid G1 (FIG. 2a). Sine the voltage level at the surfaces 44 is quite high, the electrons from electron beam 14 strike at a velocity to cause more electrons to be "knocked off" of surfaces 44 than are caused to remain due to the impact velocity of the electron beam so that the surface potential rises from point 53 (which is at the +280 volt level) toward a more positive level, as represented by point 54, along the silicon dioxide surface 44. In the same manner as was described in connection with FIG. 1*d*, the charge pattern across the target surface will range from a minimum of +280 volts to a maximum of +290 volts and preferably a maximum of +285 volts. Thus a potential gradient will be developed across the silicon dioxide layer 41*b* as represented by dotted line 55 in FIG. 2*e*. The potential at the silicon dioxide/silicon nitride interface 43 will be raised only very slightly to the point 56 so that the potential gradient across the silicon nitride layer will be substantially the same as that shown in FIGS. 2c and 2d by curve portion 45b'.

Turning now to a consideration of the read mode the target voltage is shifted downwardly to the read level which is of the order of +10 volts (relative to the cathode) as represented by curve portion 45a' in FIG. 2f. Curve portion 45b' represents the voltage gradient across layer 41a while curve portion 55 represents the voltage gradient across layer 41b. It can be seen that the downward shift in target voltage from a level of +300 volts to a level of the order of 10 volts causes a similar shift at the points 54 and 56 in FIG. 2e to the points 54' and 56' in FIG. 2f whereby point 56' at interface 43 is slightly above the level of −10 volts and point 54' is at a level of the order of −5 volts or less and preferably in the range from −5 to −10 volts relative to the cathode.

With the target voltage now fixed at the read mode level, the electron beam 14 is caused to scan the coplanar grid pattern. The electron beam is not modulated during the read operation. The level of the voltage at the surface 44 of layers 41b regulates the amount of current from electron beam 14 which will strike the exposed conducting silicon surfaces 11a with the charge pattern on surface 44 functioning in much the same manner as the control grid of a vacuum tube triode which regulates the amount of current flowing to the anode of the triode whereby the more negative the control electrode the less current flowing to the anode. The target current is detected and its maximum value represents a "white" condition while its minimum value represents a "black" condition. The target current is amplified and employed as a grid modulating signal to a cathode ray tube display device which is operated (i.e. scanned) in synchronism with the scanning of the electron storage tube shown in FIG. 2a operating in the read mode. The maximum target current is developed when the surface potential at 44 is closest to the 0 volt level while the minimum target current is developed when the potential at surface 44 is closest to the −10 volt level.

During the read operation, the electron beam, upon striking the deceleration grid mesh DM (which is used to gather "knocked off" electrons from the coplanar grid), causes radiation to be generated which affects the layer 41b by making it more conductive. The increased conductivity of the layer which would normally permit the electrons to transfer to the higher potential level of the conducting silicon as described in connection with FIG. 1e is prevented from doing so in the embodiment of FIG. 2a due to the fact that the potential along interface 43 (represented by point 56') is more negative than point 54' thereby preventing surface charge from being transferred from surface 44 to interface 43 so as to provide a very significant improvement in retention time.

In addition thereto, if any fading does occur, it should be noted that the effect of layer 41a, which serves as a miniature "biased battery," will cause electrons to drift in the direction from the interface 43 toward surface 44 causing the "white" level to fade toward "black" which is the reverse of retention fading which occurs in conventional storage targets, for example of the type shown in FIG. 1a. This feature is extremely advantageous for use in interactive display systems employing electronic storage tubes and making use of the selective erase characteristics of such tubes.

The erase mode functions in substantially the same manner as was described in connection with FIG. 2c wherein the target voltage is raised to the erase level which is usually of the order of +20 volts causing point 54' shown in FIG. 2f to shift upwardly along dotted line 44 so as to reach a level which is usually of the order of a maximum of +5 volts and in most cases is no greater than +10 volts. The electron beam cathode, maintained at reference voltage, causes the electrons in the beam to be attracted by the surface 44 of layers 41b driving the surface potential more negative so as to shift point 54' downwardly from a plus voltage level ultimately to a level of 0 volts whereupon the potential distribution across the target structure is shown by curve portions 45a', 45b' and 45' of FIG. 2c.

Furthermore, since a field in the silicon dioxide appears only for a silicon dioxide surface potential shift $\Delta \Phi_{ox}$ from the zero field condition of FIG. 2d, $\phi_s = V_{TR} - V_{TE}$, the change in $\Delta \Phi_{ox}$ with time is given by the expression $\Delta \Phi_{ox}(t) = (\Delta \Phi_{ox\ initial})\ e\text{-}t/\tau_{REL}$.

Hence, the fade takes the full relaxation time $\tau_{REL}$ and is exponential in nature (i.e. "gray" levels fade similarly). In the normal target structure as shown in FIG. 1a, black fades toward white at a greatly accelerated rate due to the very high electric field distribution across the silicon dioxide as represented by the expression $V_{TE}/T_{SiO2}$ where $V_{TE}$ is the target voltage erasure level and where $T_{SiO2}$ is the thickness of the silicon dioxide layer.

Measurements on actual electronic storage tubes having targets of the type shown in FIG. 2a have shown that for this target structure a $\tau_{REL}$ of the order of 50 to 60 minutes was observed, whereas for a structure of similar dimensions employing only silicon dioxide as represented by the target structure 10 of FIG. 1a, retention time was only 7 minutes. Furthermore, it has been found that the erase level remained absolutely stable for hours.

Figure 3A:
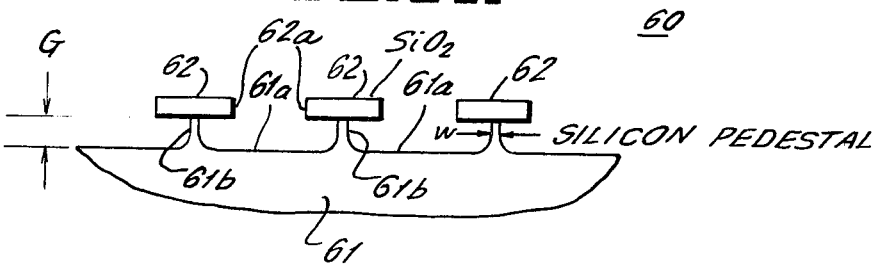
FIG. 3*a* shows another preferred embodiment of the target structure embodying the principles of the present invention.

FIG. 3a shows still another preferred embodiment of the present invention wherein the radiation insensitive level employed in FIG. 2a is replaced by a "vacuum gap." As shown in FIG. 3a the structure 60 is comprised of conducting silicon 61 which has been etched so as to form a plurality of thin elongated pedestals 61b each having supported thereon a layer or strip 62 of silicon dioxide with silicon dioxide layers being elongated strips whose longitudinal axes are substantially coincident with the longitudinal axes of pedestals 61b. The width W of the pedestals is chosen so as to have an insignificant effect upon the dielectric constant of the "vacuum gap." For this reason the pedestal may be formed of conducting silicon or any of the insulation materials employed to form layers 41a or 41b of FIG. 2a and mentioned hereinabove.

The spacing between confronting edges 62a of adjacent elongated strips 62 is chosen to as to expose the conducting silicon in the regions 61a in substantially the same manner as is shown in FIG. 2a. The depth G of the gap between the underside of each elongated strip 62 and the confronting surfaces 61a of conducting silicon 61 lies in the range of from 0.05 μM to 3 μM and preferably in the range from 0.1 μM to 1 μM. The width W of the slender pedestals 61b is of the order of 5 to 50 percent of the width of the insulating strips 62a and preferably falls in the range from 10 to 30 percent of the width of the strips 62a. It can be seen that in terms of the operation just described in connection with the embodiment of FIG. 2a that the "vacuum gap" serves the same function as the radiation insensitive material such as silicon nitride employed as a layer 41a in FIG. 2*a*.

Figure 3B:
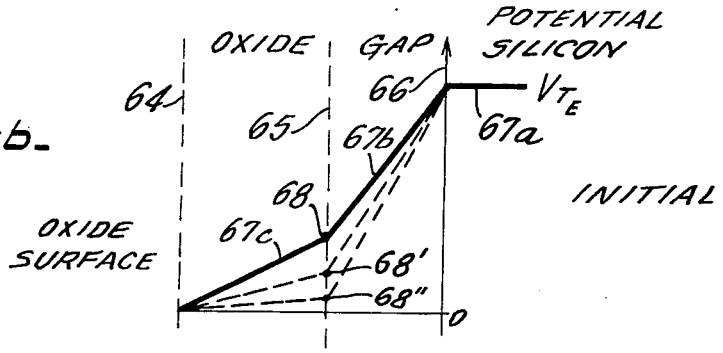
FIGS. 3*b*–3*d* show the potential distribution across the target structure for various operating modes of the embodiment shown in FIG. 3*a*.
Figure 3C:
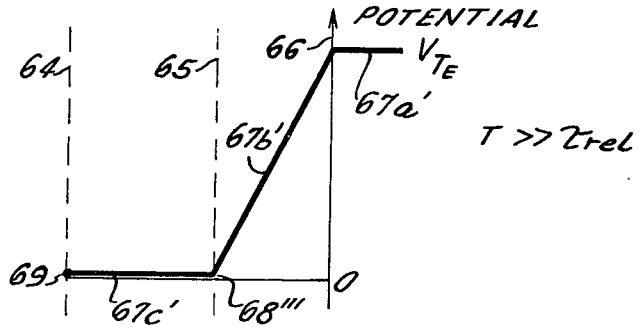
Figure 3D:
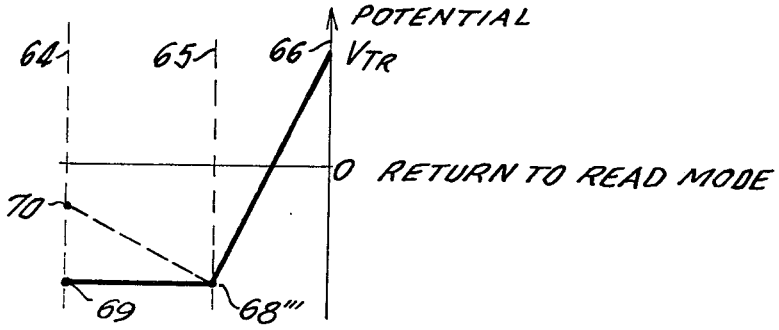

FIGS. 3*b* through 3*d* will now be considered to explain the operation of the alternative embodiment 60 shown in FIG. 3*a*.

Let it be assumed that the target voltage of target structure 60 is shifted to the erase level which is typically of the order of +20 volts as shown by $V_{TE}$ in FIG. 3*b*. The electron beam is caused to scan the target and is unmodulated at this time (i.e. has a constant beam current). Since the cathode of the electron beam is maintained at ground or reference potential, a uniform charge distribution will be developed across the surfaces of the coplanar grid strip 62 so that the surface potential, as represented by dotted line 64 in FIG. 3*b*, is at 0 volts. Since the dielectric constant of the silicon dioxide strips 62 is higher than the dielectric constant of a vacuum (it being understood that the electron storage tube comprises an envelope which is evacuated), the potential distribution across the gap, which extends from interface 65 shown in FIG. 3*b* to the exposed surface areas 61*a* and represented by line 66 in FIG. 3*b*, will be substantially greater than the potential distribution across the silicon dioxide layers as represented respectively by curve portions 67*b* and 67*c* respectively.

In the presence of ionizing radiation, and during a period of time greater than the induced conductivity relaxation time of the oxide, the electrons along surface 64 will transfer to interface 65 so that break point 68 between curve portions 67*b* and 67*c* moves progressively downward as shown by points 68' and 68'' until the potential gradient across the oxide layers 62 is constant and zero as shown by curve portion 67*c'* in FIG. 3*c*. Thus substantially all of the potential gradient will be across the vacuum gap as represented by curve portion 67*b'* of FIG. 3*c* and once this condition is achieved, the electron storage tube is now "conditioned" for operation in the extremely advantageous manner as described in connection with the embodiment of FIG. 2*a*. It should be understood that the pedestals 61*b* are sufficiently narrow so as to have a significantly reduced effect upon the transfer of charge from the silicon dioxide strips 62 to the conducting silicon 61.

FIG. 3*d* shows the resultant curve when the electron storage tube is in the read mode. In this condition the target voltage is lowered to a value of the order of +10 volts. Since the voltage distribution across the vacuum gap G and the silicon dioxide cannot change instantaneously (due to the fact that they both function as capacitances) their voltage levels at the interface 65 and surface 64 will shift down by an equal amount so that point 68''' shown in FIG. 3*c* and point 69 which lies along surface 64 will both be at −10 volts.

If the electron beam is caused to scan across the target structure the negative potential at surface 64 will prevent any electrons in beam 14 from striking the conducting silicon areas 61*a* so that no target current will be detected indicating that the erase operation has been successfully completed.

The write mode functions in substantially the same manner as was described above in connection with the embodiment of FIG. 2*a* and the representative curve of FIG. 2*f*. The target voltage is shifted upwardly to a value typically of the order of +300 volts and the modulated electron beam strikes the surface 64 at such a high velocity as to cause more electrons to be "knocked off" of surface 64 than land. This drives the surface 64 more positive depending upon the modulation level of the modulating signal applied to the control grid G1 (see FIG. 2*a* for example). Once the write mode is completed and it is desired to operate in the read mode, the target voltage is shifted downwardly to a level of the order of +10 volts whereupon the surface potential will range from a value as shown by point 69 in FIG. 3*d* to point 70. Since all of these values will be less than 0 volts and since the cathode of the electron gun is maintained at reference potential, all points of the surface pattern will be more negative than the electron gun cathode with the values of the points of the image causing a larger target current the closer these points are to the 0 volt level and a smaller target current the more removed they are from the 0 volt level (and hence more negative).

In the same manner that a "white" level will tend to fade toward "black" as was described in connection with FIG. 2*e*, the identical and unique feature will be obtained through the target embodied in FIG. 3*a*.

It should be noted that the ionizing radiation used to "set" the target (i.e. to cause the silicon dioxide, or similar insulation material potential gradient to reduce towards zero) can be developed either internally or externally. For example, the radiation used to render the silicon dioxide level more conductive can be derived from the grid deceleration mesh DM or can be an externally applied radiation source such as for example ultra-violet light, *x*-radiation from an *x*-ray source and the like. Thus, when the erase mode develops the curves represented by curve portions 67*a*, 67*b* and 67*c* of FIG. 3*b*, the target is substantially simultaneously exposed to ionizing radiation, such as *x*-radiation or ultra-violet light, causing the break point 68 at interface 65 to move progressively downward until the voltage gradient pattern shown by curve portions 67*a'*, 67*b'* and 67*c'* of FIG. 3*c* is obtained. The use of an external radiation source or an appropriate voltage on the grid deceleration mesh permits the "conditioning" of the target to obtain the voltage distribution as shown in FIG. 3*c* to be obtained rather rapidly.

Although in describing FIG. 2*a*, layer 41*b* was described as the radiation sensitive layer and 41*a* as the radiation resistant layer the positions of the layers may be reversed without substantially modifying the principle of operation. FIGS. 4*a* through 4*e* show the potential profiles for the embodiment of FIG. 2*a* but where 41*b* is the radiation insensitive layer and 41*a* is the radiation sensitive layer.

The erasing, writing and reading sequence is identical. The result of the built-in potential in layer 41*b* is again to allow the electric field or potential gradient in radiation sensitive layer 41*a* to be reduced to zero (erased) or to near zero (written).

Briefly FIG. 4*a* shows the potential distribution upon completion of an erasure operation. It should be noted that the larger voltage gradient is across layer 41*a* which is now the radiation sensitive layer. FIG. 4*b* shows the target as it undergoes transfer of charge, the potential gradient being successively reduced across layer 41*a* as shown by curve portions 45*b*, 45*b'*, 45*b''*, 45*b'''* while the potential gradient 45*c* increases to 45*c'*, 45*c''*, 45*c'''*. The target is now checked for successful completion of the erase operation as shown in FIG. 4*c*. The surface potential at 46 being more negative than the cathode, prevents the generation of any target current $I_T$ (FIG. 2*a*).

FIG. 4*d* shows the writing phase where the surface potential is raised from point 46 to 46' due to the secondary emission effect also causing a slight increase from point 47 to 47' at interface 43. FIG 4*e* shows the read phase. The advantageous "battery" effect is retained since the layer 41*b* is the radiation insensitive layer.

Also, although the method of transferring charge to the interface between the two insulating layers has been limited to ionizing radiation induced conductivity, other methods are possible. For example, field induced tunneling of charge from the silicon into the insulator and to the interface is also possible and can be used to create the desired internal "battery" effect. It can therefore be seen from the foregoing description that the present invention provides a novel target structure having extremely enhanced image and erasure capabilities. In addition thereto a novel method has been described herein for "conditioning" the novel target structure so as to obtain the extremely enhanced image retention characteristic and to further cause white levels to fade toward black in cases where any fading occurs.

Although there has been described a preferred embodiment of this novel invention, many variations and modifications will now be apparent to those skilled in the art. Therefore, this invention is to be limited, not by the specific disclosure herein, but only by the appending claims.

What is claimed is:

1. An electronic storage tube including a target comprised of a pattern of substantially coplanar conducting areas and insulating charge storage areas, the tube comprising:

means including electron beam generating means and beam modulating means for developing a desired stored potential distribution on the surface of the insulating charge storage areas of the target representative of the image to be stored;

means for detecting the desired stored potential distribution on the target;

said conducting areas being exposed to said beam and being electrically connected to each other and wherein one surface of each of the insulating areas are exposed to said beam each area being composed of at least two layers of insulating materials where at least one insulating layer is capable of conducting charge at an increased rate in the presence of ionizing radiation, and at least one of the remaining insulating layers is resistant to such effects of ionizing radiation; one of said layers being deposited upon the remaining one of said layers; and further including conditioning means for causing electronic charge to be redistributed within the layers of the insulating charge storage areas.

2. The apparatus of claim 1, wherein the storage of electronic charge within the charge storage areas is effected so that for negative surface potentials on the charge storage area relative to the conducting area potential the potential gradient across the radiation sensitive layer or layers of said charge storage area is significantly reduced thereby as compared with said layer or layers which are resistant to ionizing radiation.

3. The apparatus of claim 2 wherein for said negative surface potential corresponding to a desired erase potential said potential gradient is substantially zero.

4. The apparatus of claim 1, wherein said conditioning means includes means for generating ionizing radiation which impinges on the insulating charge storage areas of said target.

5. The apparatus of claim 1, wherein the first layer is silicon dioxide and the second layer is composed of a material selected from the group containing silicon nitride, silicon oxy-nitride, and aluminum oxide.

6. The apparatus of claim 1, wherein the conducting areas are formed of silicon.

7. The apparatus of claim 1, wherein the conditioning means for generating ionizing radiation comprises a metallic "deceleration grid" mesh means for maintaining said mesh at a predetermined voltage level, said mesh confronting and being positioned adjacent to the insulating storage areas of the target and being scanned by the electron beam to develop the ionizing radiation by interaction with said mesh.

8. The apparatus of claim 7, wherein said voltage maintaining means provided for maintaining the potential of the mesh provides a level which is greater than 300 volts relative to the cathode.

9. An electronic storage tube, including a target structure comprising conducting means for collecting beam current from an electron beam scanning the target structure and developed by beam generating means and means for modulating said beam current to create a charge pattern distribution representing an image to be stored;

beam current regulating means, positioned immediately adjacent the conducting means and including insulation means possessing a first surface for storing said electric potential pattern which controls beam current reaching the conducting means, said insulation means having a second surface confronting and being spaced from said conducting means to create a vacuum gap region between the insulation means second surface and the conducting means;

pedestal means positioned between said conductive means and said insulation means second surface for supporting said insulation means so as to maintain the vacuum gap between said insulation means and said conducting means;

conditioning means to cause a charge redistribution within the insulating material to alter the voltage gradient thereacross, and where said insulation means is comprised of one or more layers of insulating material deposited one upon the other, at least one layer of which is formed of a material whose conductivity increases in the presence of ionizing radiation.

10. The apparatus of claim 9, wherein said conditioning means comprises means for exposing said insulation means to the presence of ionizing radiation to effect the redistribution of charge within the insulation material to alter the voltage gradient across said layer.

11. The apparatus of claim 10, wherein the conditioning means causes the charge stored on the second surface of said layer to be sufficient to cause the potential gradient between said first and second surfaces to be substantially zero.

12. The apparatus of claim 10, wherein said insulation layer is composed of silicon dioxide.

13. The apparatus of claim 11, wherein said insulation layer is composed of silicon dioxide.

14. The apparatus of claim 9, wherein the conducting means is silicon.

15. The apparatus of claim 9, wherein the pedestals are silicon.

16. The apparatus of claim 9, wherein the pedestals are formed of an insulating material.

17. A method for conditioning an electronic storage tube target structure comprising a conductive layer coupled to a target electrode and a coplanar grid structure comprised of an ionizing radiation resistant insulation layer and a second insulation layer capable of conducting electrons from its surface at an increased rate in the presence of such ionizing radiation, the method comprising:

elevating the voltage of said target electrode to raise the level of the grid surface of the coplanar grid structure above a reference level;

scanning said grid surface with an electron beam to uniformly reduce the grid surface to said reference level, thereby developing a potential distribution across the insulation layer which is a function of the dielectric constants of said first and second layers;

exposing the target to ionizing radiation for a period sufficient to cause a redistribution of charge within said second layer to substantially reduce the electrical potential distribution across the the second layer to zero thereby conditioning the grid surface to be capable of storing a charge pattern representative of an image to be stored and to retain said pattern substantially indefinitely even in cases where the stored image repetitively read out.

18. A method for conditioning an electronic storage tube target structure comprising a conductive layer coupled to a target electrode and a coplanar grid structure comprised of a radiation sensitive insulation layer capable of transferring charge from a first surface towards said conductive layer at an increased rate in the presence of such ionizing radiation, and being separated from the conductive layer to substantially provide a vacuum gap therebetween, the method comprising:

elevating the voltage of said target electrode to raise the level of the grid surface above a reference level;

scanning said grid surface with an electron beam to uniformly reduce the grid surface to said reference level, thereby developing a potential distribution across the insulation layer which is a function of the dielectric constants of said layer and the vacuum gap between the insulation layer and the conducting layer;

exposing the target to ionizing radiation for a period sufficient to cause a redistribution of charge in said second layer to substantially reduce the electric potential distribution across the insulation layer to zero.

19. The method of claim 18 wherein the voltage of said target electrode during said scanning is elevated to a value sufficient to cause complete cutoff of the beam to the target when the target voltage is subsequently lowered to a predetermined read potential.

20. The method of claim 19 wherein the voltage of said target electrode during said scanning is elevated to a value sufficient to cause complete cutoff of the beam to the target when the target conducting member voltage is subsequently lowered to its read potential.

21. The structure of claim 9 wherein said conducting means comprise a conducting silicon member;

said insulation means comprising a plurality of elongated strips of insulation material arranged at spaced intervals along said conducting silicon member;

said silicon member being etched to form a groove between adjacent insulation strips, said grooves undercutting each elongated side of each strip whereby each strip is supported above the surface of the silicon member by a slender pedestal portion.

22. The structure of claim 21 wherein said strips are formed of silicon dioxide.

23. The structure of claim 21 wherein said strips are formed of silicon oxy-nitride.

24. The structure of claim 21 wherein said strips are formed of silicon nitride.

25. The structure of claim 21 wherein said strips are formed of aluminum oxide.

26. The structure of claim 9 wherein said conducting means comprise a conducting silicon member;

said insulation means comprising a plurality of islands of a radiation sensitive insulation material arranged at spaced intervals along said conducting silicon member;

said silicon member being etched to form grooves between adjacent insulation islands, said grooves undercutting the edges of each island whereby each island is supported above the surface of the silicon member by a slender pedestal portion.

27. The structure of claim 26 wherein said islands are formed of silicon dioxide.

28. The structure of claim 9 wherein said conducting means comprise a conducting silicon member;

said insulation means comprising a grid pattern of a radiation sensitive insulation material containing openings arranged at spaced intervals along said conducting silicon member;

said silicon member being etched to form a depressed region under each of said openings in said insulating grid where said depressed regions undercut each edge of said openings whereby said grid is supported above the surface of the silicon member by a slender pedestal portion.

29. The structure of claim 28 wherein said grid is formed of silicon dioxide.

30. A method of operating electronic storage tubes conditioned by the method steps of claim 17 and further comprising:

scanning the target with the electron beam;

elevating the target voltage to a level sufficient to cause the electron beam to strike the grid surface with a velocity sufficient to "knock off" more electrons than land on said grid surface;

modulating the beam density during beam scanning to control the amount of electrons "knocked off" of the grid surface, said modulation being adapted to form a charge pattern on said grid surface representing the image to be stored by the target.

31. The method of claim 30 comprising reading out the stored image.

32. The method of claim 31 wherein read out of a stored image comprises the steps of lowering the target voltage to a level sufficient to cause the most positive insulator grid surface potential to lie below the potential level of the electron beam source;

scanning the target with the electron beam while maintaining a substantially constant beam current density, whereby said grid structure surface potential controls the amount of electrons reach said conducting member;

detecting the target current.

33. The method of claim 31 further comprising the step of coupling the target current to a cathode ray tube display device whose electron beam is scanned in synchronism with the electronic storage tube and modulating said beam by said target current to display the image stored by said target.

34. The method of claim 30 comprising the steps of erasing a stored image comprising:

shifting the target voltage to a level sufficient to raise the lowest surface voltage of said grid structure above said reference level, said level being further chosen to cause more electrons from the beam to land on said target than are "knocked off";

scanning the target with the electron beam being maintained at a substantially constant beam current to develop a substantially uniform surface potential across said grid structure which surface potential is substantially equal to said reference level.

35. The method of claim 17 further including providing a deceleration grid mesh and elevating the voltage level of said mesh, wherein the ionizing radiation is generated simultaneously with said scanning of the target by the beam scanning of the metallic "deceleration grid" mesh placed in front of and adjacent to the target surface.

36. The method of claim 18 further including providing a deceleration grid mesh and elevating the voltage level of said mesh, wherein the ionizing radiation is generated simultaneously with said scanning of the target by the scanning of a metallic "decelerating grid" mesh placed in front of the target surface.

37. The method of claim 35 wherein the potential of said decelerating grid mesh is raised to a level of greater than 300 volts relative to said reference level.

38. The apparatus of claim 1 wherein said pattern is a striped pattern.

39. The apparatus of claim 1 wherein said pattern is an island pattern with said charge storage areas each being completely surrounded by a conducting area.

40. The apparatus of claim 1 wherein said pattern is a grid pattern with said conducting areas each being completely surrounded by a charge storage area.

* * * * *